US008029385B2

(12) United States Patent
Horacek et al.

(10) Patent No.: US 8,029,385 B2
(45) **Date of Patent: *Oct. 4, 2011**

(54) GOLF CLUB HEAD

(75) Inventors: Robert J. Horacek, Hermosa Beach, CA (US); Dustin J. Brekke, Westminster, CA (US)

(73) Assignee: SRI Sports Limited, Kobe-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/770,170

(22) Filed: Apr. 29, 2010

(65) Prior Publication Data

US 2010/0255932 A1 Oct. 7, 2010

Related U.S. Application Data

(63) Continuation of application No. 12/071,462, filed on Feb. 21, 2008, now Pat. No. 7,758,453.

(51) Int. Cl.
*A63B 53/04* (2006.01)

(52) U.S. Cl. ..... 473/345; 473/346

(58) Field of Classification Search ..... 473/324–350, 473/287–292

See application file for complete search history.

(56) References Cited

U.S. PATENT DOCUMENTS

| | | | |
|---|---|---|---|
| 1,592,463 | A | 7/1926 | Marker |
| 1,658,581 | A | 2/1928 | Tobia |
| 2,460,435 | A | 2/1949 | Schaffer |
| 4,602,787 | A | 7/1986 | Sugioka et al. |
| 4,681,321 | A | 7/1987 | Chen et al. |
| 5,180,166 | A | 1/1993 | Schmidt et al. |
| 5,295,689 | A | 3/1994 | Lundberg |
| 5,419,559 | A | 5/1995 | Melanson et al. |
| 5,547,427 | A | 8/1996 | Rigal et al. |
| 5,718,641 | A | 2/1998 | Lin |
| 5,908,356 | A | 6/1999 | Nagamoto |
| 5,941,782 | A | 8/1999 | Cook |
| 6,059,669 | A | 5/2000 | Pearce |
| 6,162,133 | A | 12/2000 | Peterson |
| 6,254,494 | B1 | 7/2001 | Hasebe et al. |
| 6,340,337 | B2 | 1/2002 | Hasebe et al. |
| 6,558,271 | B1 | 5/2003 | Beach et al. |

(Continued)

FOREIGN PATENT DOCUMENTS

| | | |
|---|---|---|
| JP | A-11-299937 | 11/1999 |

(Continued)

OTHER PUBLICATIONS

Nov. 24, 2009 Office Action issued in U.S. Appl. No. 12/071,462.

(Continued)

*Primary Examiner* — Sebastiano Passaniti
(74) *Attorney, Agent, or Firm* — Oliff & Berridge, PLC

(57) ABSTRACT

A golf club head according to one or more aspects of the present invention comprises a striking surface having a face center, a crown portion, and a sole portion, four quadrants, and a linear stiffening element coupled to at least one of the crown portion and the sole portion. The linear stiffening element may extend from the heel region to the toe region of the club head. The stiffening element is disposed in at least three of the four quadrants, at an angle between 50° and 85° relative to an imaginary vertical plane oriented substantially perpendicular to the striking surface and containing the face center. The stiffening element has a survey length, the ratio of the overall width to the survey length being less than 0.97.

20 Claims, 12 Drawing Sheets

U.S. PATENT DOCUMENTS

| | | | | |
|---|---|---|---|---|
| 6,878,073 | B2 | 4/2005 | Takeda | |
| 6,945,877 | B2 | 9/2005 | Kobayashi et al. | |
| 6,974,393 | B2 | 12/2005 | Caldwell et al. | |
| 7,041,189 | B2 | 5/2006 | Caldwell et al. | |
| 7,056,228 | B2 | 6/2006 | Beach et al. | |
| 7,059,973 | B2 | 6/2006 | Erickson et al. | |
| 7,066,835 | B2 | 6/2006 | Evans et al. | |
| 7,074,136 | B2 | 7/2006 | Noguchi et al. | |
| 7,140,974 | B2 | 11/2006 | Chao et al. | |
| 7,351,161 | B2 | 4/2008 | Beach | |
| 7,396,298 | B2 | 7/2008 | Jertson et al. | |
| 7,563,178 | B2 | 7/2009 | Rae et al. | |
| 7,758,453 | B2 * | 7/2010 | Horacek et al. | 473/345 |
| 7,803,067 | B2 * | 9/2010 | Horacek et al. | 473/345 |
| 2002/0169035 | A1 | 11/2002 | Liu | |
| 2003/0171162 | A1 | 9/2003 | Park | |
| 2005/0075192 | A1 | 4/2005 | Han | |
| 2005/0148405 | A1 | 7/2005 | Imamoto | |
| 2006/0073909 | A1 | 4/2006 | Evans et al. | |
| 2006/0172818 | A1 | 8/2006 | Yamamoto | |
| 2006/0217215 | A1 | 9/2006 | Erickson et al. | |
| 2007/0099726 | A1 | 5/2007 | Rife | |
| 2007/0117648 | A1 | 5/2007 | Yokota | |

FOREIGN PATENT DOCUMENTS

| | | |
|---|---|---|
| JP | A 2001-204856 | 7/2001 |
| JP | A 2001-238988 | 9/2001 |

OTHER PUBLICATIONS

Mar. 25, 2010 Office Action issued in U.S. Appl. No. 12/071,462.

Apr. 16, 2010 Notice of Allowance issued in U.S. Appl. No. 12/071,462.

* cited by examiner

GOLF CLUB HEAD

RELATED U.S. APPLICATION DATA

Continuation of application Ser. No. 12/071,462, filed on Feb. 21, 2008.

COPYRIGHT AUTHORIZATION

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

Wood-type golf club heads generally weigh between about 150 g and about 250 g. A portion of this mass sustains the structural integrity of the club head. The remaining mass, referred to as "discretionary" mass, may be strategically distributed to improve the mass properties and/or the inertial characteristics of the head.

It is well known in the art that the dynamic-excitation response of a golf club head may have a profound effect on the player's confidence and performance. Many golfers associate a pleasing sound at ball impact with superior performance and a poor sound with inferior performance.

Wood-type club heads have increased in size in recent years to enlarge the sweet spot of the striking surface. As the size of the club head has increased, most manufacturers have thinned the club-head walls to maintain the head weight within a useable range. However, such a construction often adversely affects the dynamic-excitation response of the club head at ball impact because the thinned walls of the head possess a plurality of high-deflection regions that promote unfavorable vibrational frequencies. To improve the dynamic-excitation response of the club head, the regions of high deflection may be reinforced with, e.g., rib-like structures or stiffening elements. Typically, each region of high deflection is provided with a discrete stiffening structure, thus significantly reducing the available discretionary mass of the club head.

SUMMARY

The present invention, in one or more aspects thereof, may comprise a golf club head having greater forgiveness on mishit shots, reduced hook/slice tendencies, and an improved dynamic-excitation response.

In one example, a golf club head in accordance with one or more of aspects of the present invention may include a crown portion, a sole portion, and a striking surface having a face center. The club head may be divided into four quadrants, and a linear stiffening element may be disposed in at least three of the four quadrants at an angle between 50° and 85° to an imaginary vertical plane, oriented substantially perpendicular to the striking surface and containing the face center. The linear stiffening element may be coupled to at least one of the crown portion and the sole portion.

In another example, a golf club head in accordance with one or more aspects of the present invention may include a crown portion, a sole portion, an overall width, and a striking surface having a face center. A linear stiffening element may be coupled to at least one of the crown portion and the sole portion. The linear stiffening element may comprise a survey length and may be oriented at an angle between 50° and 85° to an imaginary vertical plane that is substantially perpendicular to the striking surface and contains the face center. The ratio of the overall width of the club head to the survey length of the stiffening element may be less than 0.97.

In another example, a golf club head in accordance with one or more aspects of the present invention may include an overall width, a crown portion, a sole portion, a toe region, and a heel region. The club head may be divided into at least four quadrants. A linear stiffening element may be disposed in at least three of the four quadrants and may extend from the heel region to the toe region. The linear stiffening element may be coupled to at least one of the crown portion and the sole portion.

These and other features and advantages of the golf club head according to the invention in its various aspects, as provided by one or more of the examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

Exemplary implementations of the present invention will now be described with reference to the accompanying drawings, wherein.

DETAILED DESCRIPTION

The following examples of the golf club head according to one or more aspects of the present invention will be described using one or more definitions, provided below.

Figure 1:
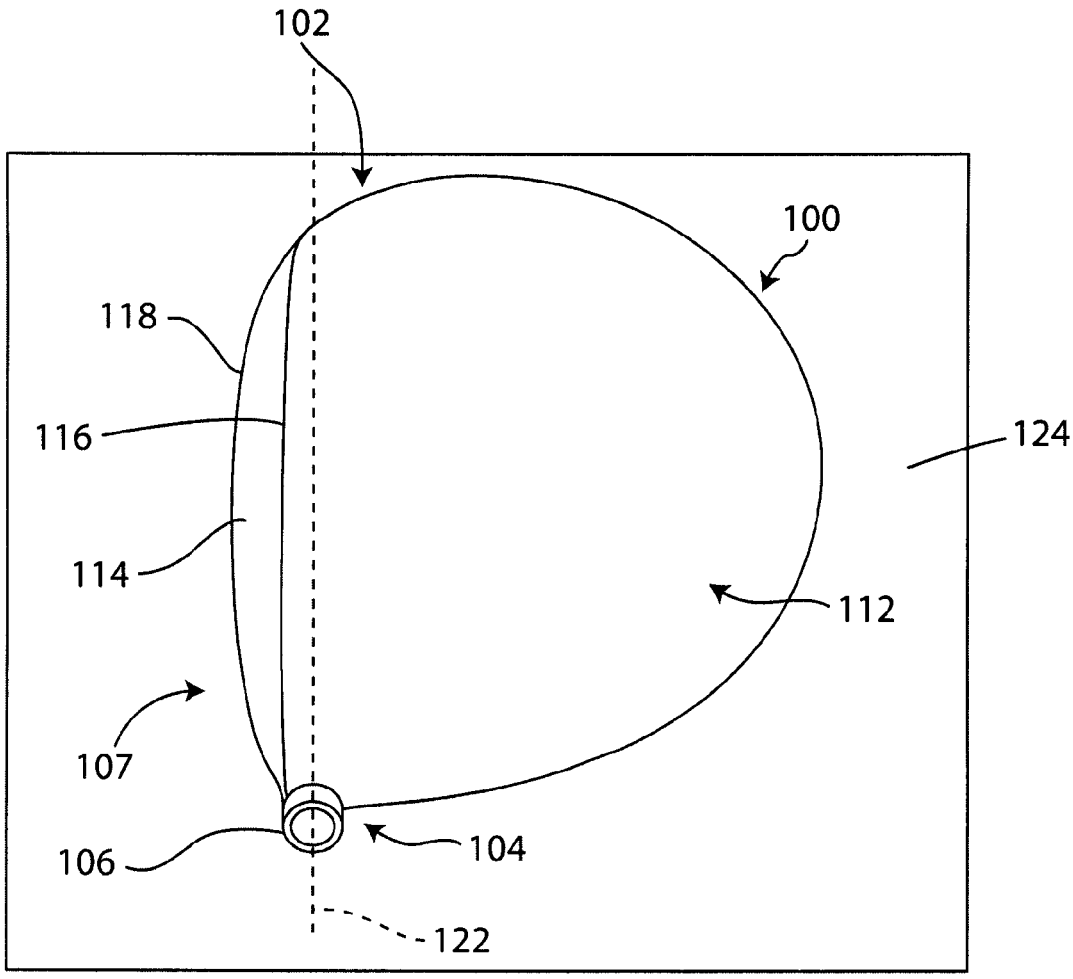
FIG. 1 is a top plan view of an exemplary golf club head according to one or more aspects of the present invention.
Figure 1A:
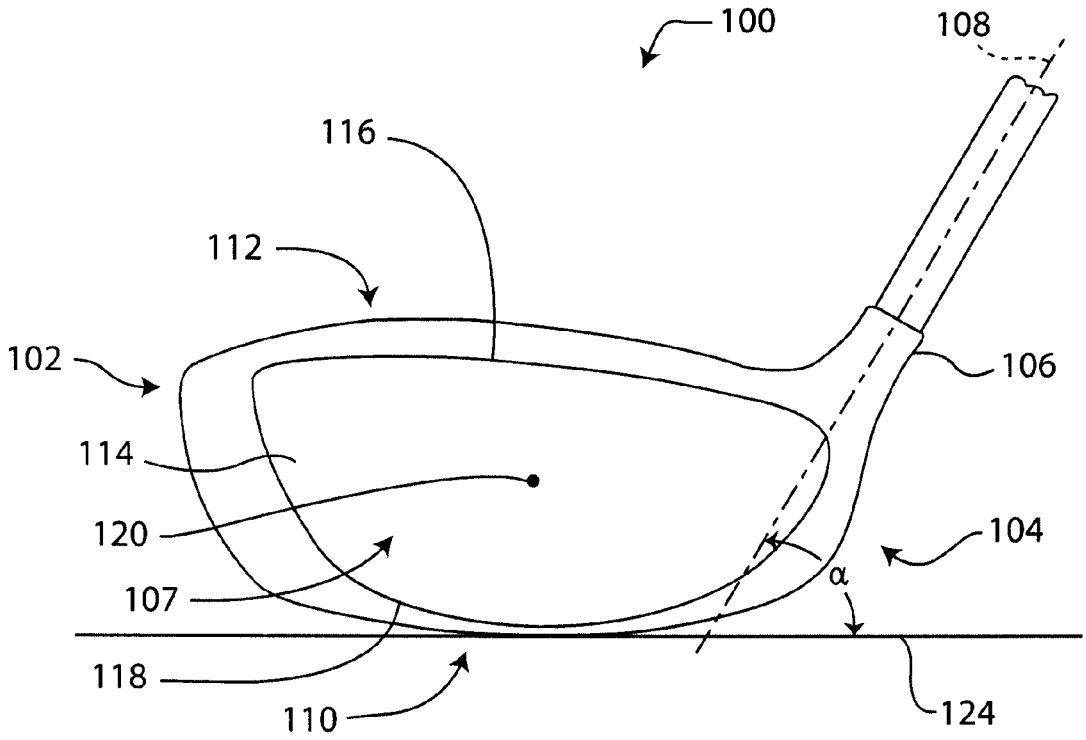
FIG. 1A is a front elevational view of the golf club head of FIG. 1.

Referring to FIGS. 1 and 1A, a club head 100 may comprise a toe 102, a heel 104, a hosel 106, having a central axis (centerline) 108, a sole portion 110, a crown portion 112, and a face portion 107, including a striking surface 114. The striking surface 114 may have a top edge 116, a leading edge 118, and a face center 120.

Referring again to FIGS. 1 and 1A, "reference position," as used herein, denotes a position of the club head 100 where the hosel centerline 108 is in an imaginary vertical plane 122 and is oriented at a lie angle α of substantially 60° with respect to a ground plane 124. The plane 122 is oriented substantially parallel to the striking surface 114. Unless otherwise indicated, all parameters below are specified with the club head in the reference position.

Figure 1B:
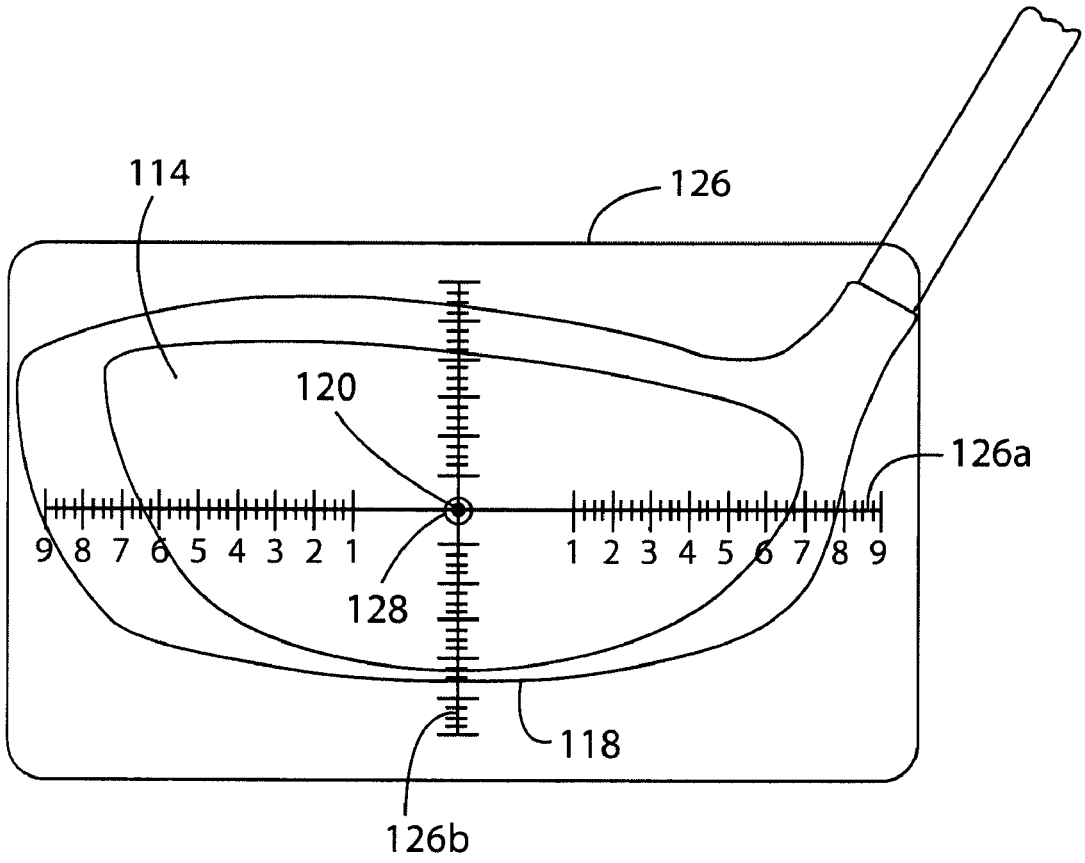
FIG. 1B is a front elevational view of the golf club head of FIG. 1 with a template applied thereto.

Referring to FIGS. 1A and 1B, "face center", e.g., a face center 120, as used herein, may be located using a template 126, having a coordinate system with a heel-toe axis 126*a* that is orthogonal to a sole-crown axis 126*b*. An aperture 128 may be located at the origin of the coordinate system and each axis may be divided into evenly spaced increments. The template 126 may be made of a flexible material, e.g., a transparent polymer. The template is used as follows:

1) The template 126 is placed on the striking surface 114 with the heel-toe axis 126*a* substantially parallel to the leading edge 118. The template is then moved back and forth in the heel-toe direction along the striking surface 114 until the heel and toe measurements at the opposite edges of the striking surface 114 are equal.
2) The template 126 is moved back and forth in the sole-crown direction along the striking surface 114 until the sole and crown measurements at the opposite edges of the striking surface 114 are equal.
3) The template 126 is moved with respect to the striking surface 114 as described in steps 1 and 2, above, until the heel and the toe as well as the sole and the crown measurements along the corresponding axes are equal. A point is then marked on the striking surface via the aperture 128 to indicate the face center 120.

Figure 1C:
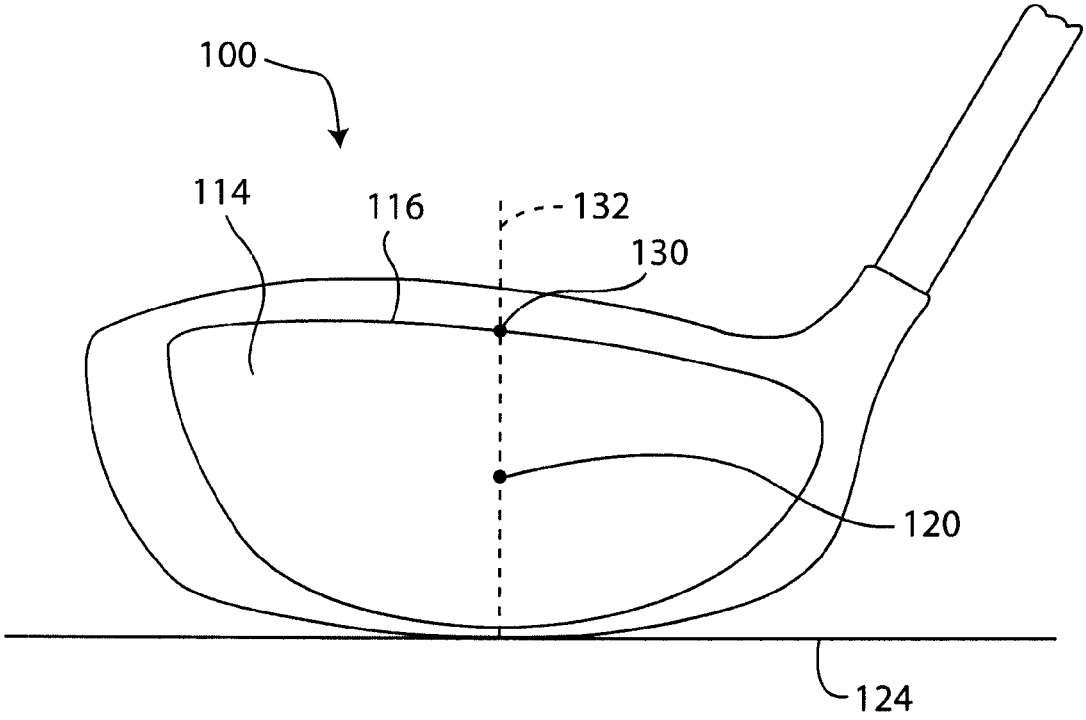
FIG. 1C is a front elevational view of the golf club head of FIG. 1.

Referring to FIG. 1C, "center apex", e.g., a center apex 130, as used herein, refers to a point of intersection between an imaginary longitudinal vertical plane 132 and the top edge 116 of the striking surface 114, with the club head 100 in the reference position. The plane 132 is oriented substantially perpendicular to the striking surface 114 and passes through the face center 120.

Figure 1D:
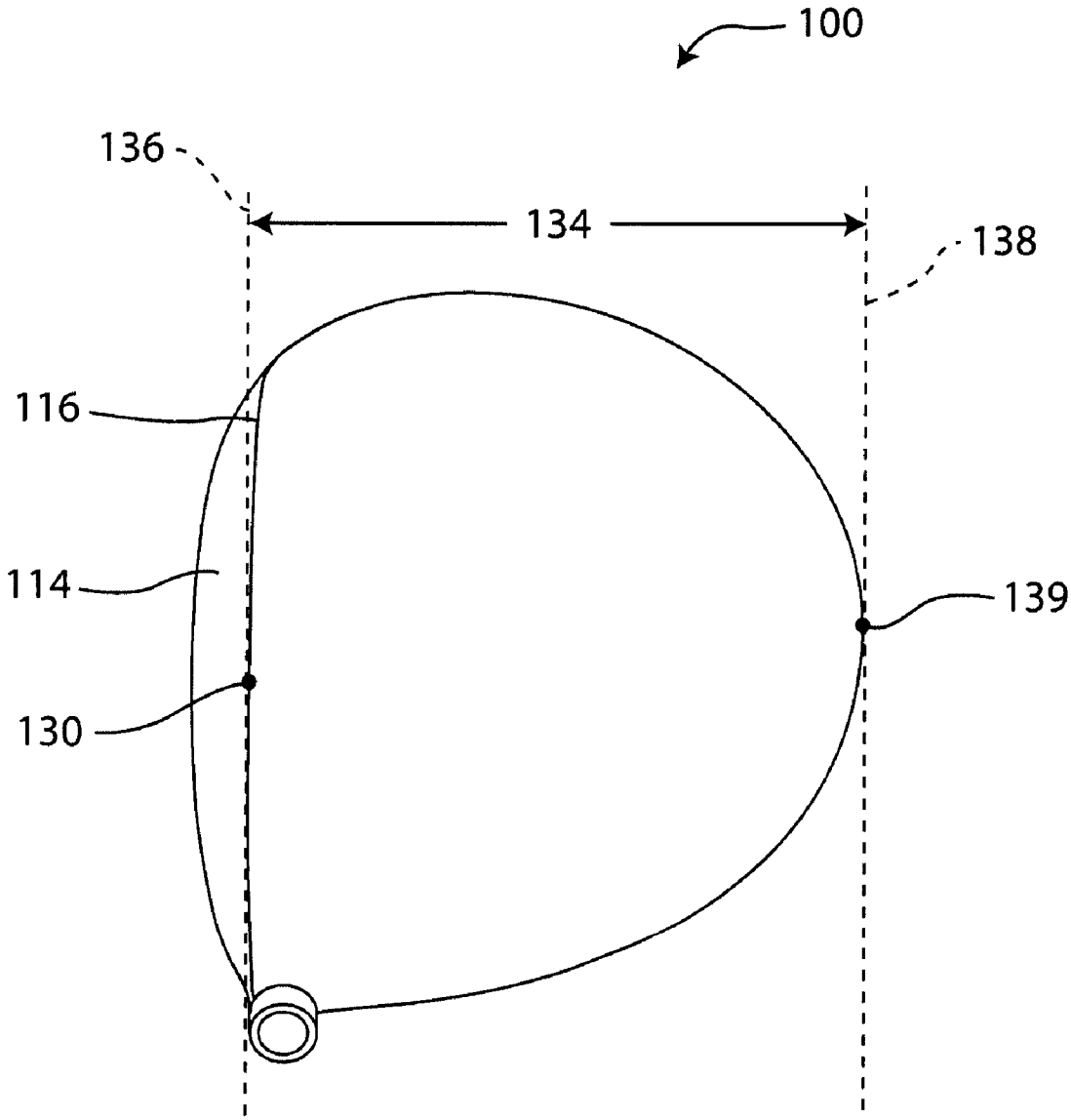
FIG. 1D is a top plan view of the golf club head of FIG. 1.

Referring to FIG. 1D, "overall length", e.g., an overall length 134, as used herein, denotes the shortest horizontal distance between an imaginary front vertical plane 136, substantially parallel to the top edge 116 and passing through the center apex 130, and an imaginary rear vertical plane 138 that is parallel to the front vertical plane 136 and passes through the furthest rearwardly projecting point 140 of the club head 100, opposite the striking surface 114.

Figure 1E:
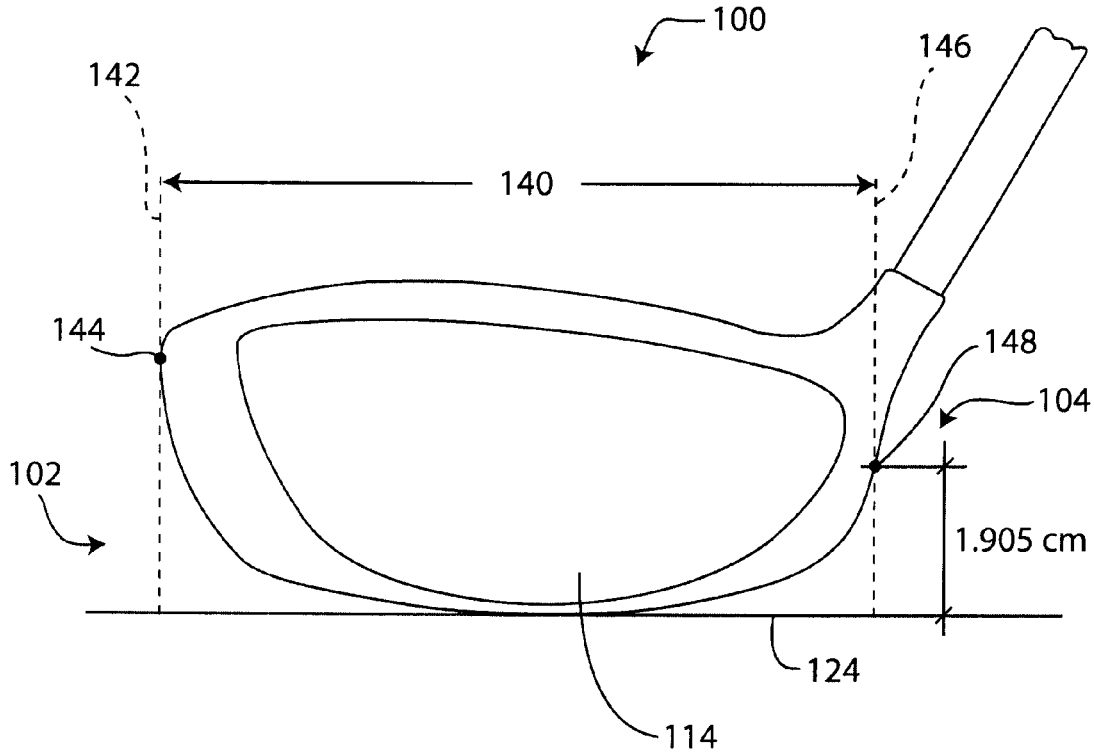
FIG. 1E is a front elevational view of the golf club head of FIG. 1.

Referring to FIG. 1E, "overall width", e.g., an overall width 140, as used herein, denotes the shortest horizontal distance between an imaginary toe-side vertical plane 142, substantially perpendicular to the striking surface 114 and passing through a furthest laterally projecting toe point 144, and an imaginary heel-side vertical plane 146 that is substantially perpendicular to the striking surface 114 and passes through a furthest laterally projecting heel point 148, located at a vertical height of 1.905 cm (0.75 in) relative the ground plane 124, with the club head 100 in the reference position.

Figure 1F:
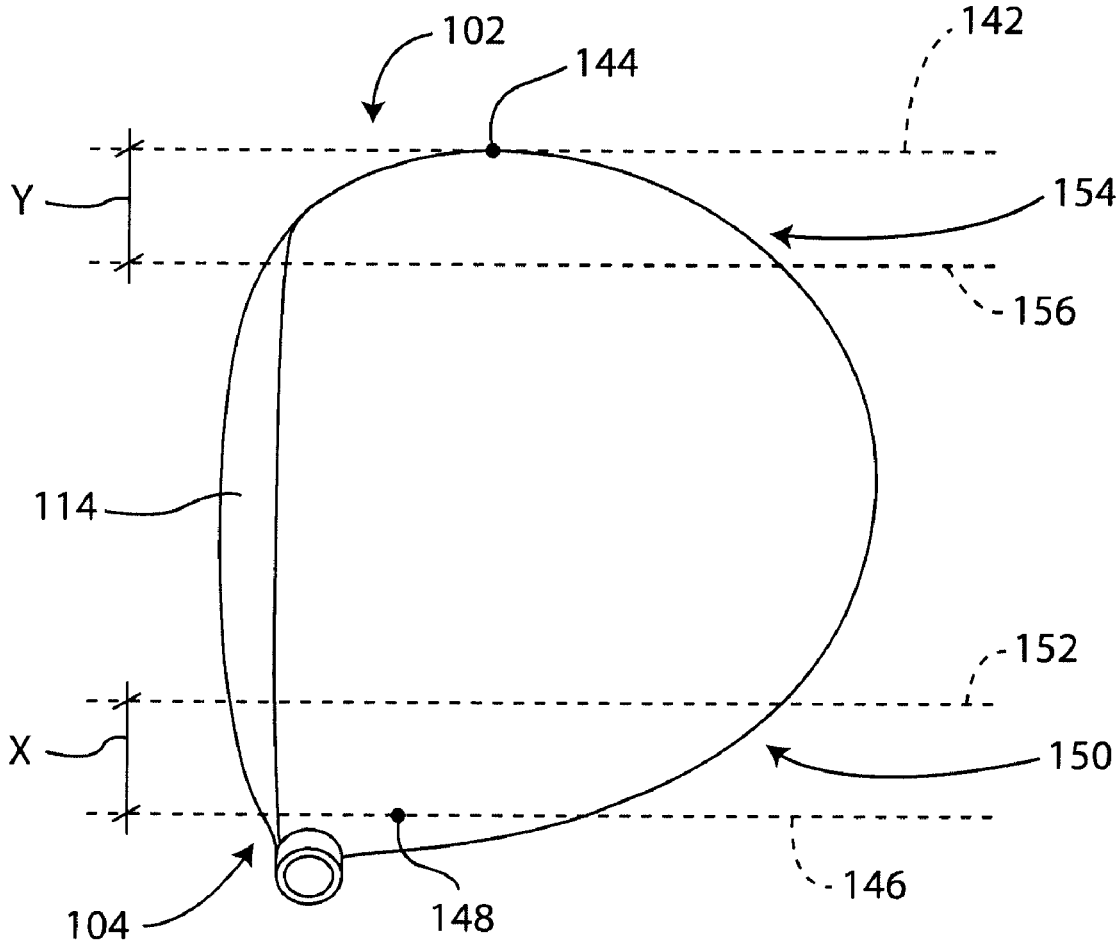
FIG. 1F is a top plan view of the golf club head of FIG. 1.

Referring to FIG. 1F, "heel region", e.g., a heel region 150, as used herein, denotes the portion of the club head between the imaginary heel-side vertical plane 146, substantially perpendicular to striking surface 114 and passing through the furthest laterally projecting heel point 148, located at a vertical height of 1.905 cm (0.75 in) relative the ground plane 124, and an imaginary offset heel-side vertical plane 152. The plane 152 is parallel to the plane 146 and is spaced a distance X therefrom in the direction of toe 102. Preferably, the distance X may be less than 20% of the overall length of the club head, more preferably less than 15% of the overall length of the club head, and most preferably less than 10% of the overall length of the club head.

Referring again to FIG. 1F, "toe region", e.g., a toe region 154, as used herein, denotes the portion of the club head between the imaginary toe-side vertical plane 142, substantially perpendicular to striking surface 114 and passing through the furthest laterally projecting toe point 144, and an imaginary offset toe-side vertical plane 156. The plane 156 is parallel to the imaginary toe-side vertical plane 142 and is spaced a distance Y therefrom in the direction of the heel 104. Preferably, the distance Y may be less than 20% of the overall length of the club head, more preferably less than 15% of the overall length of the club head, and most preferably less than 10% of the overall length of the club head.

Figure 2:
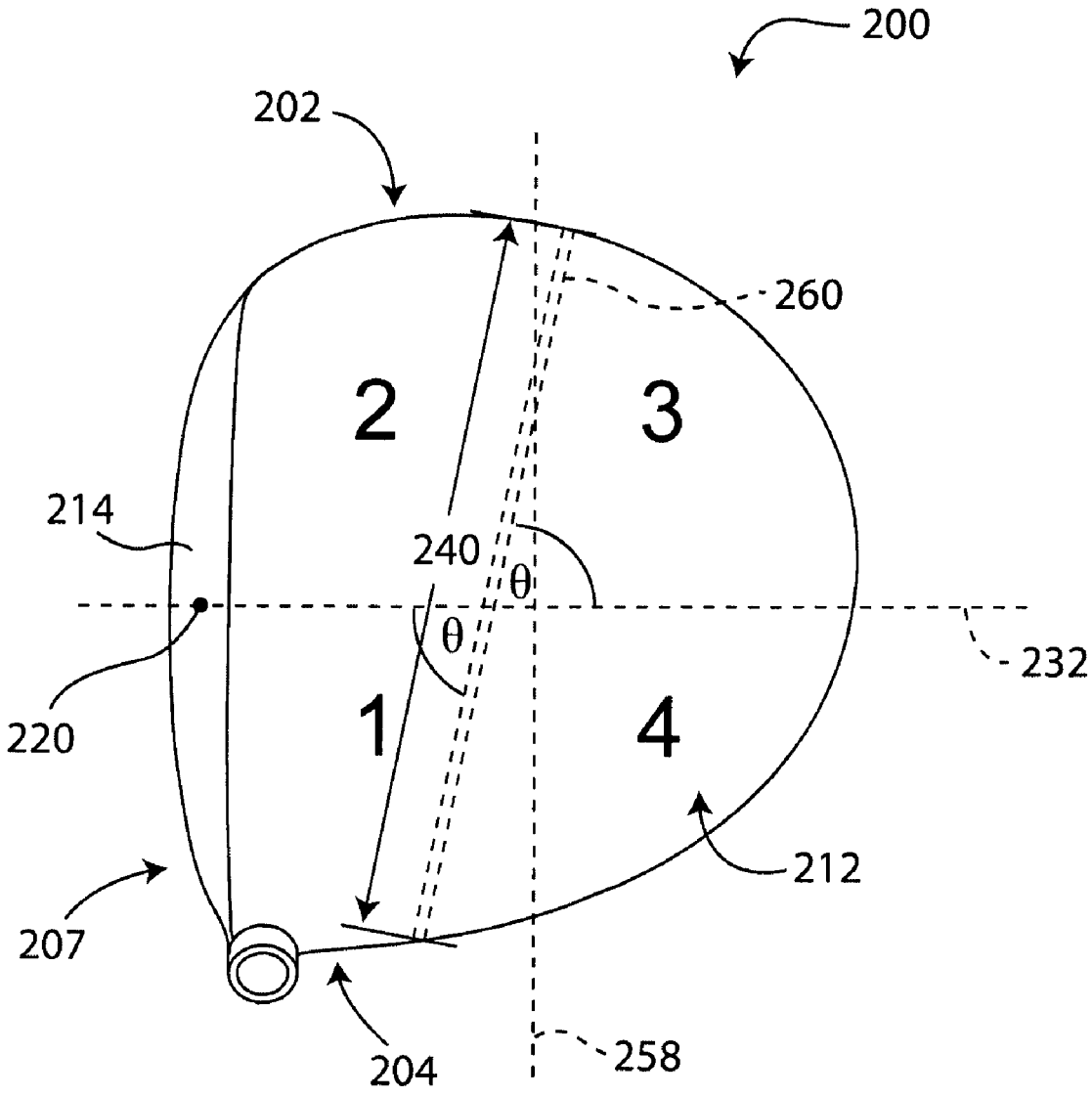
FIG. 2 is a top plan view of an exemplary golf club head according to one or more aspects of the present invention.

Referring to FIG. 2, "survey length", e.g., a survey length 240, as used herein, denotes the maximum horizontal length of a stiffening element 260 in a top plan view with the golf club head 200 in the reference position.

As illustrated in FIG. 2, the club head 200, oriented in the reference position, is divided into four quadrants by an imaginary longitudinal vertical plane 232, substantially perpendicular to a striking surface 214 and passing through a face center 220, and an imaginary transverse vertical plane 258, orthogonal to the imaginary longitudinal vertical plane 232 and bisecting the club head 200 at one-half the overall length. A first quadrant, Quadrant 1, is proximate the striking surface 214 and a heel 204 of the club head. A second quadrant, Quadrant 2, is proximate the striking surface 214 and a toe 202 of the club head. A third quadrant, Quadrant 3, is proximate the toe and is located rearward of Quadrant 2. A fourth quadrant, Quadrant 4, is proximate the heel and is located rearward of Quadrant 1.

Referring again to FIG. 2, the club head 200 may have an interior cavity characterized by a crown portion 212, a sole portion (not shown), the toe 202, the heel 204, and a face portion 207. The linear stiffening element 260 may be disposed within the interior cavity and may extend from the heel region to the toe region, as defined with respect to FIG. 1F.

To orient the stiffening element 260 within the interior cavity of the club head, at least two regions of high deflection may be identified, e.g., using computational analysis and/or empirical techniques. Once the high-deflection regions have been identified, the stiffening element 260 is disposed in at least three of the four quadrants, described above, at an angle θ to the imaginary longitudinal vertical plane 232, such that the stiffening element 260 passes through at least two of the identified regions of high deflection to improve the dynamic excitation response of the club head. For example, the linear stiffening element 260 may be oriented at an angle between 50° and 85° relative to the plane 232, preferably between 60° and 85° relative to the plane 232, and more preferably between 70° and 85° relative to the plane 232, depending on the location of the high-deflection regions of the club head. By using a single stiffening element to reinforce more than one high-deflection region, an increase in discretionary mass may be achieved. The discretionary mass may be distributed in the club head to improve mass properties and/or inertial characteristics.

Figure 2A:
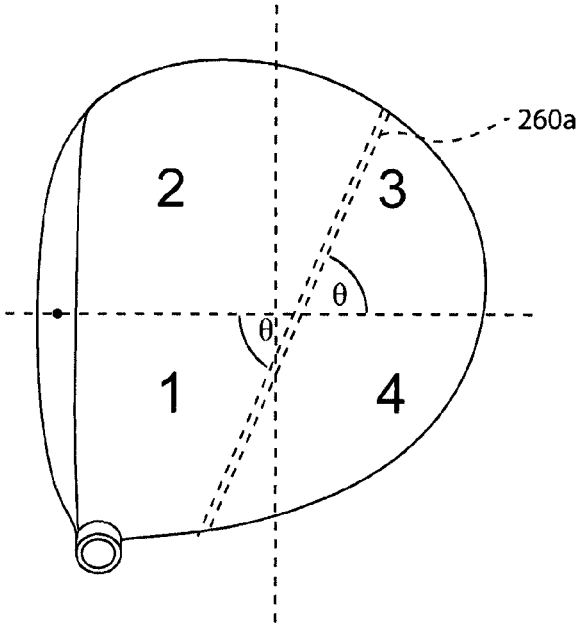
FIG. 2A is a top plan view of an exemplary golf club head according to one or more aspects of the present invention.
Figure 2B:
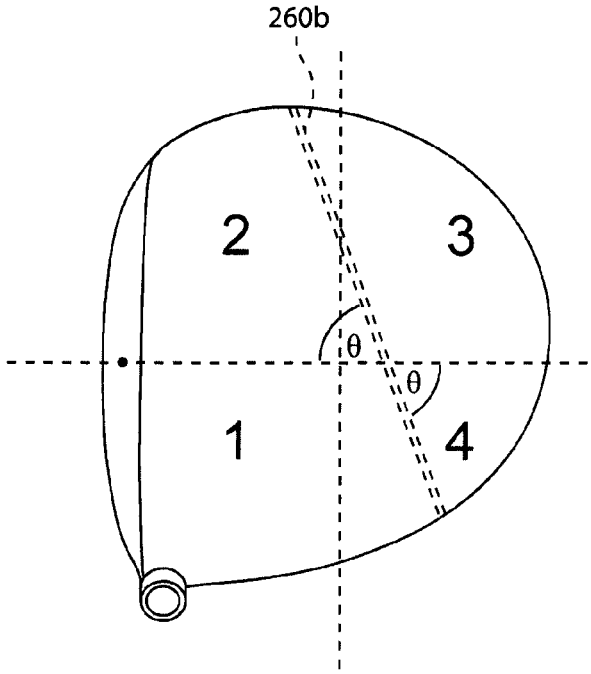
FIG. 2B is a top plan view of an exemplary golf club head according to one or more aspects of the present invention.

The stiffening element, according to one or more aspects of the present invention, may be disposed within the interior cavity in any orientation. For example, as shown in FIG. 2, the stiffening element 260 may be disposed in the first, second, and third quadrants at an angle θ to the imaginary longitudinal vertical plane 232. In other examples, the stiffening element, e.g., stiffening element 260*a* (FIG. 2A), may be disposed in the first, third, and fourth quadrants. Preferably, the stiffening element, e.g., stiffening element 260*b* (FIG. 2B), may be disposed in the second, third, and fourth quadrants. More preferably, stiffening element, e.g., stiffening element 260*c* (FIG. 2C), may be disposed in the first, second, and fourth quadrants.

Figure 2C:
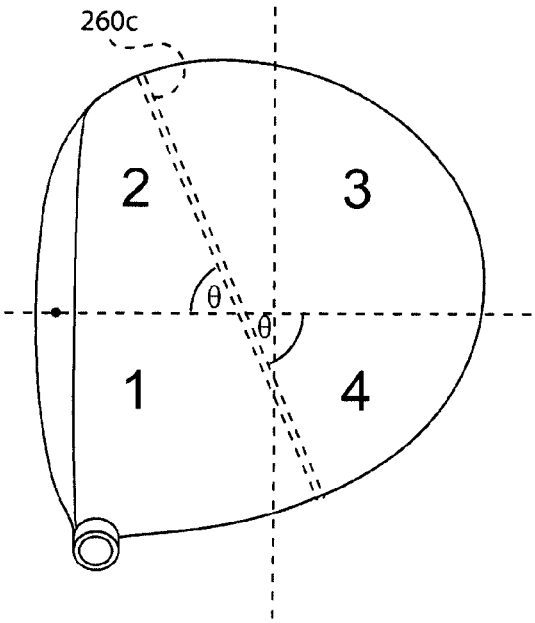
FIG. 2C is a top plan view of an exemplary golf club head according to one or more aspects of the present invention.

Referring to FIGS. 2-2C, the use of an advantageously oriented stiffening element, according to one or more aspects of the invention, e.g., stiffening elements 260-260C, produces a club head having a favorable dominant resonant frequency of vibration. The dominant resonant frequency of vibration is the frequency that produces the greatest sound energy. To measure the sound energy of a given resonant frequency, a time-amplitude plot, with the amplitude along the y-axis and the time along the x-axis, may be generated. The resonant frequency having the greatest area underneath the curve is the dominant resonant frequency of vibration. Generally, the first resonant frequency of vibration is the dominant resonant frequency. Preferably, the first resonant frequency of vibration may be between about 1800 Hz and about 7500 Hz, more preferably between about 2500 Hz and about 6000 Hz, and most preferably between about 3000 Hz and about 5000 Hz. In some instances, the dominant resonant frequency may be the second, the third, the fourth, or the fifth resonant frequency of vibration.

Further tuning of the dynamic-excitation response of the club head may be achieved by modifying the width and/or height of at least a portion of the stiffening element, according to one or more aspects of the present invention, in the regions of high deflection. For example, the stiffening element may comprise one or more heights corresponding to one or more regions of high deflection. Moreover, the stiffening element may comprise one or more widths corresponding to one or more regions of high deflection. Increasing the height and/or the width of the stiffening element advantageously reduces the deflection in the corresponding region or regions of the club head. The width of the stiffening element may vary between about 0.2 mm and about 5 mm, preferably between about 0.75 mm and about 2 mm, and more preferably between about 1 mm and 1.5 mm. The height of the stiffening element may vary between about 1 mm and about 25 mm, preferably between about 3 mm and about 20 mm, more preferably between about 5 mm and about 15 mm, and most preferably between about 8 mm and about 12 mm.

The survey length, e.g., the survey length 240 (FIG. 2), of the stiffening element 260 may be greater than the overall width of the club head. For example, the ratio of the overall width to the survey length may be less than 0.97, preferably less than 0.95, more preferably less than 0.90, and most preferably between 0.85 and 0.97, depending on the angle between the stiffening element 260 and the plane 232. A longer stiffening element may be required to reinforce multiple regions of high deflection. The overall width of the club head may be greater than about 110 mm, preferably greater than about 115 mm, and more preferably greater than about 130 mm. The survey length, e.g., the survey length 240, may be at least about 50 mm, preferably at least about 100 mm, and more preferably at least about 125 mm.

The stiffening element, in one or more aspects thereof, may be coupled to at least one of the sole portion and the crown portion, e.g., by welding, adhesive bonding, or integrally casting the stiffening element with the club head. Suitable adhesives include thermosetting adhesives in a liquid or a film medium, e.g., two-part liquid epoxy, modified acrylic liquid adhesive, foam tape, or the like.

Figure 3A:
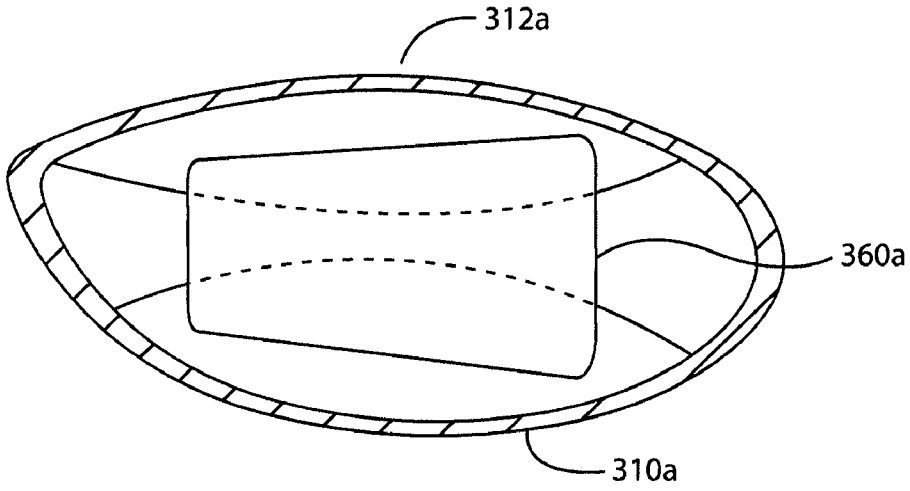
FIG. 3A is a front cross-sectional view of an exemplary golf club head according to one or more aspects of the present invention.

Referring to FIG. 3A, orientation of the stiffening element relative the crown and/or the sole may be determined by the location of the high-deflection regions of the club head. For example, regions of high deflection may be located on both the sole portion 310*a* and the crown portion 312*a*. As shown in FIG. 3A, the stiffening element 360*a* may be coupled to both the sole portion 310*a* and the crown portion 312*a* to reinforce such high-deflection regions, thus improving the dynamic-excitation response of the club head. Additionally, the stiffening element may be coupled to portions of the club head other than the sole portion and the crown portion.

Figure 3B:
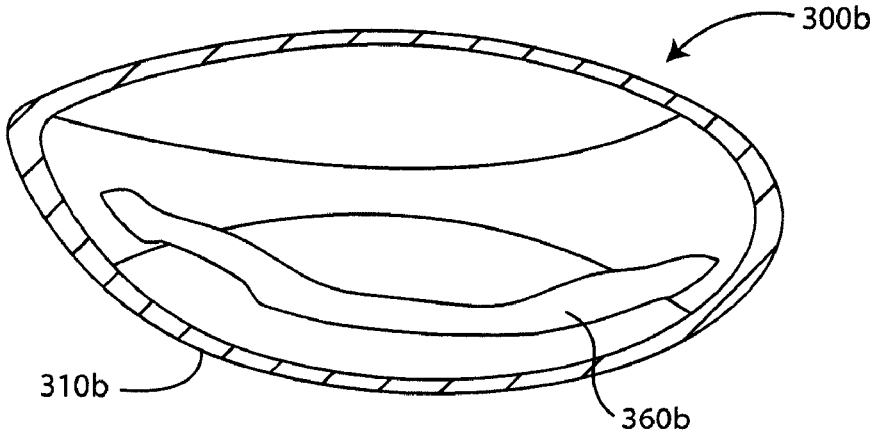
FIG. 3B is a front cross-sectional view of an exemplary golf club head according to one or more aspects of the present invention.
Figure 3C:
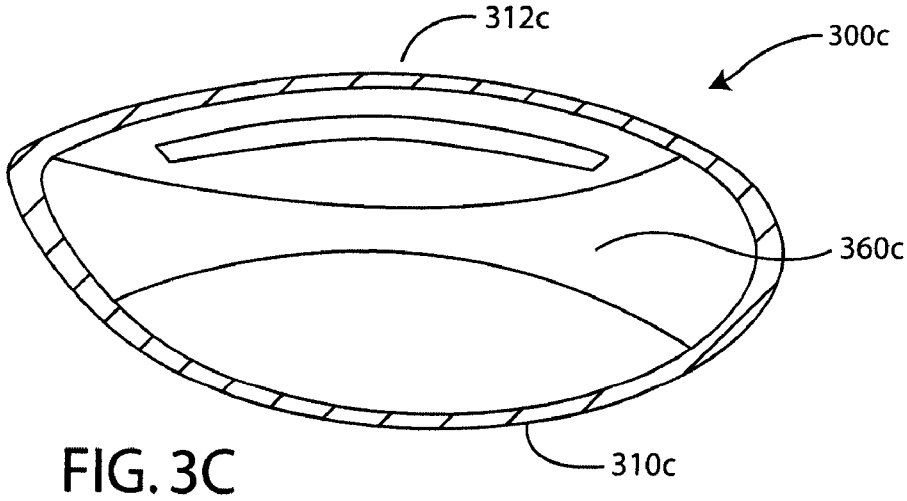
FIG. 3C is a front cross-sectional view of an exemplary golf club head according to one or more aspects of the present invention.

FIG. 3B illustrates a club head where the regions of high deflection may be located primarily in a sole portion 310*b* of club head 300*b*. Hence, a single linear stiffening element 360*b* may be disposed on the sole portion. In another example, shown in FIG. 3C, the regions of high deflection may be located primarily on a crown portion 312*c* of the club head 300*c*. Thus, a single linear stiffening element 360*c* may be disposed on the crown portion.

The stiffening elements described above may be formed from metallic and/or non-metallic materials. Examples of metallic materials suitable for fabricating the stiffening elements may include stainless steel, 6-4 titanium alloy, 10-2-3 Beta-C titanium alloy, 6-22-22 titanium alloy, or the like. Suitable non-metallic materials may include composite materials, e.g., CFRP, and thermoplastic materials, e.g., polyurethanes, polyesters, polyamides, and ionomers. The stiffening elements may be manufactured, e.g., via a casting, forging, powdered metal forming, or injection molding process.

Figure 4:
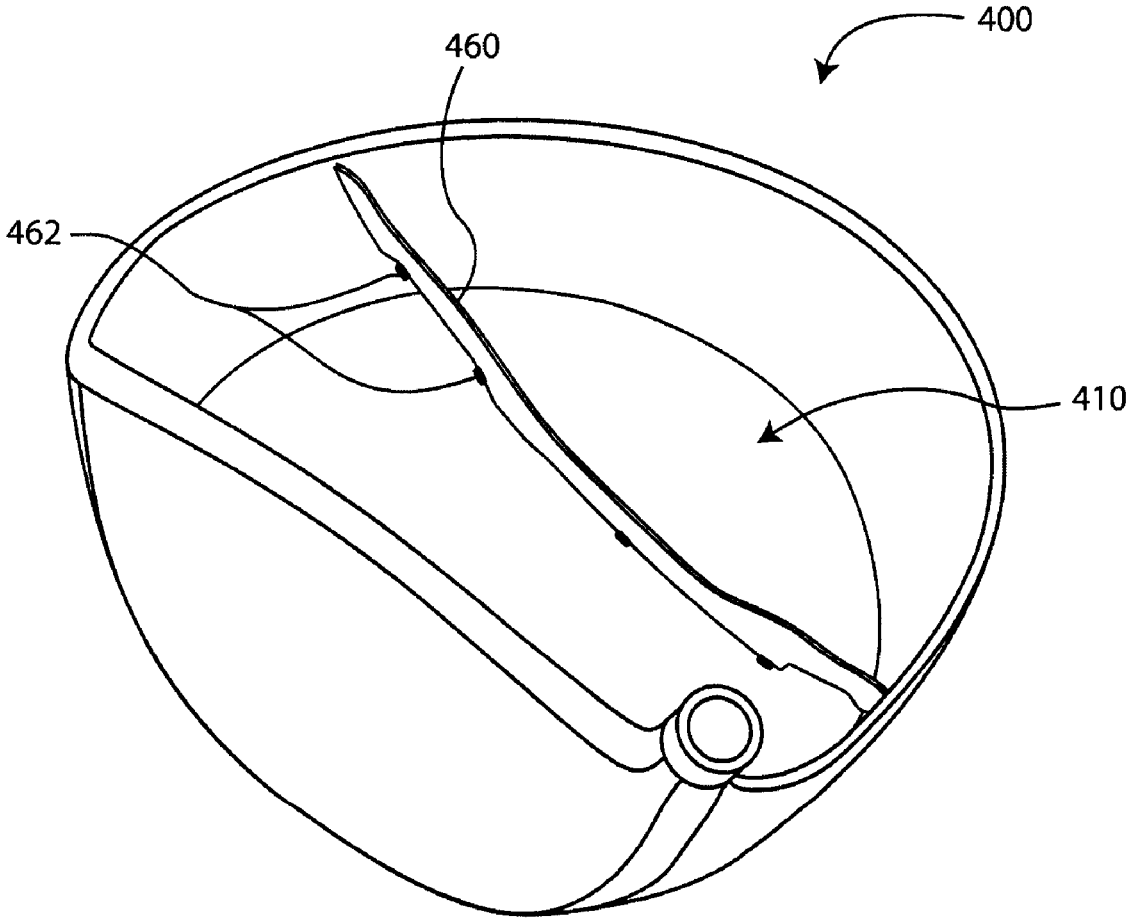
FIG. 4 is a perspective view of an exemplary golf club head according to one or more aspects of the present invention showing the club head with the crown removed.

Referring to FIG. 4, one or more welds, e.g., welds 462, may be utilized to couple the stiffening element, e.g., a stiffening element 460, to the club head. To reduce the production costs and increase production efficiency, the weld or welds may comprise less than about 70% of the survey length of the stiffening element. In another example, the weld or welds may comprise less than about 50% of the survey length, preferably less than about 30% of the survey length, and more preferably less than about 20% of the survey length.

As shown in FIG. 4, the stiffening element, e.g., the element 460, according to one or more aspects of the present invention, may be coupled to the sole portion, e.g., a sole portion 410, via a plurality of intermittent welds and/or tack welds. Preferably, each weld may be located in a region of high deflection to improve the dynamic-excitation response of the club head. Spacing between the adjacent ends of neighboring welds depends on the number and location of the high-deflection regions in the club head. Thus, each weld may be spaced between about 10 mm and about 100 mm from an adjacent weld, preferably between about 10 mm and about 50 mm from an adjacent weld, and more preferably between about 10 mm and about 25 mm from an adjacent weld.

Figure 4A:
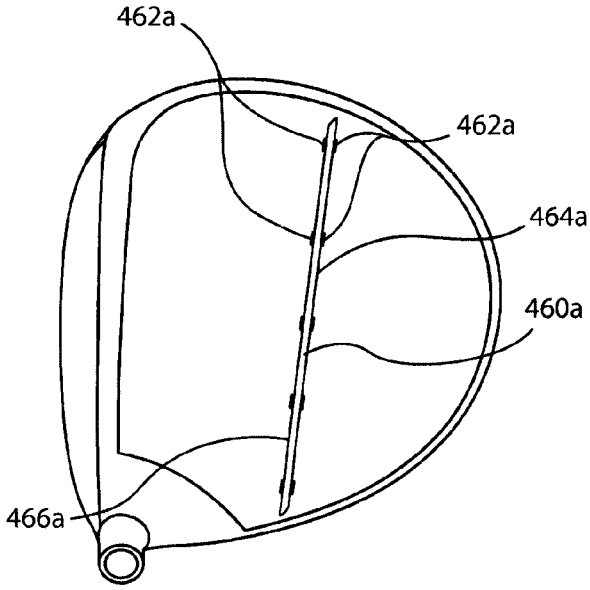
FIG. 4A is a top plan view of an exemplary golf club head according to one or more aspects of the present invention showing the club head with the crown removed.
Figure 4B:
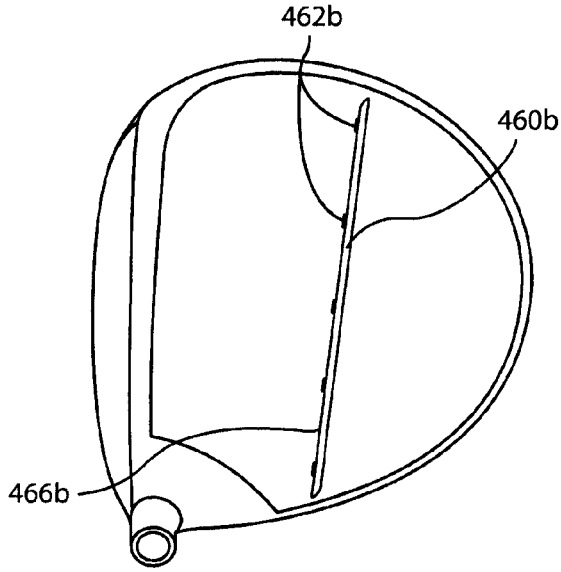
FIG. 4B is a top plan view of an exemplary golf club head according to one or more aspects of the present invention showing the club head with the crown removed.
Figure 4C:
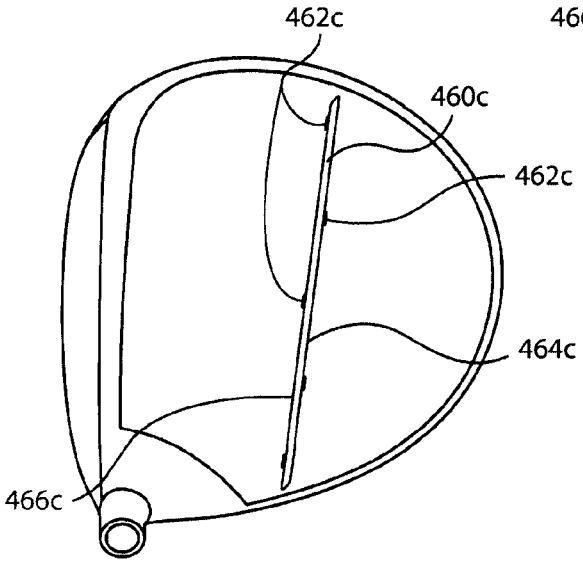
FIG. 4C is a top plan view of an exemplary golf club head according to one or more aspects of the present invention showing the club head with the crown removed.

Referring to FIG. 4A, the stiffening element, e.g., a stiffening element 460*a*, may comprise a first side, e.g., a first side 464*a*, and a second side, e.g., a second side 466*a*. A plurality of welds 462*a* may be deposited in a paired arrangement along the first and the second sides of the stiffening element 460*a*. As shown in FIG. 4B, the welds, e.g., welds 462*b*, may be located along only one side of the stiffening element. The welds, e.g., welds 462*c*, may also be disposed in a staggered arrangement on both sides of the stiffening element, as shown in FIG. 4C.

The club head may be formed from a wide variety of materials, including metals, polymers, ceramics, composites, and wood. For instance, the club heads according to one or more aspects of the present invention may be made from stainless steel, titanium, or graphite fiber-reinforced epoxy, as well as persimmon or laminated maple. In one example, the club head may be formed, at least in part, of fiber-reinforced or fiberglass-reinforced plastic (FRP), otherwise known as reinforced thermoset plastic (RTP), reinforced thermoset resin (RTR), and glass-reinforced plastic (GRP).

The face portion of the club head may be formed of SP700 Beta Titanium—an alpha/beta grade alloy of 4.5-3-2-2 Titanium (Ti—4.5% Al—3% V—2% Mo—2% Fe). In another example, portions of the club head may be formed of other titanium alloys including a forging of a high strength titanium alloy such as 10-2-3 (Ti—10% V—2% Fe—3% Al) or 15-3-3-3 (Ti—15% V—3% Cr—3% Sn—3% Al), a casting of a 6-4 alloy (Ti—6% Al—4% V), or other titanium alloys such as 3-2.5 Titanium (Ti—3% Al—2.5% V) or 15-5-3 Titanium (Ti—15% Mo—5% Zr—3% Al). In other examples, other forging and casting alloys may be used including stainless steel and aluminum.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A golf club head comprising:

a striking surface having a face center, a top edge, and a center apex;

a crown portion;

a sole portion;

a hosel having a hosel centerline, wherein the club head is oriented relative to an imaginary horizontal ground plane so that the hosel centerline is in an imaginary vertical hosel plane generally parallel to the top edge of the strike face and is at an angle of 60° relative to the imaginary horizontal ground plane;

a furthest laterally projecting toe point;

a furthest laterally projecting heel point, located at a vertical height of 0.75 in. relative to the ground plane;

an overall width defined by the shortest horizontal distance between an imaginary toe-side vertical plane, substantially perpendicular to the striking surface and passing through the furthest laterally projecting toe point, and an imaginary heel-side vertical plane, substantially perpendicular to the striking surface and passing through the furthest laterally projecting heel point;

a heel region comprising a width dimension Y, wherein the width dimension Y is less than about 20% of the overall width;

a toe region comprising a width dimension X, wherein the width dimension X is less than about 20% of the overall width;

a furthest rearwardly projecting point;

an overall length defined by the shortest horizontal distance between an imaginary front vertical plane, generally parallel to the top edge and passing through the center apex, and an imaginary rear vertical plane, parallel to the front vertical plane and passing through the furthest rearwardly projecting point of the club head;

an imaginary longitudinal vertical plane substantially perpendicular to the striking surface and passing through the face center;

an imaginary transverse vertical plane orthogonal to the imaginary longitudinal vertical plane and bisecting the club head at a point equidistant from the imaginary front vertical plane and the imaginary rear vertical plane, the imaginary transverse vertical plane intersecting the imaginary longitudinal vertical plane; and a linear stiffening element coupled to the sole portion and extending into the heel region, the linear stiffening element intersecting the imaginary longitudinal vertical plane and the imaginary transverse vertical plane and spaced from the intersection between the imaginary transverse vertical plane and the imaginary longitudinal vertical plane.

2. The golf club head of claim 1, wherein the linear stiffening element further comprises a thickness between about 0.5 mm and about 5 mm and a height between about 1 mm and about 25 mm.

3. The golf club head of claim 2, wherein stiffening element comprises a height between about 3 mm and about 20 mm.

4. The golf club head of claim 3, wherein the stiffening element comprises a height between about 5 mm and about 15 mm.

5. The golf club head of claim 4, wherein the stiffening element comprises a height between about 8 mm and about 12 mm.

6. The golf club head of claim 1, wherein the club head further comprises a first resonant frequency of vibration between about 1800 Hz and about 7500 Hz.

7. The golf club head of claim 6, wherein the first resonant frequency of vibration is between about 2500 Hz and about 6000 Hz.

8. The golf club head of claim 7, wherein the first resonant frequency of vibration is between about 3000 Hz and about 5000 Hz.

9. A golf club head comprising:

a crown portion;

a sole portion;

a striking surface having a face center, a top edge, and a center apex;

a hosel having a hosel centerline, wherein the club head is oriented relative to an imaginary horizontal ground plane so that the hosel centerline is in an imaginary vertical hosel plane generally parallel to the top edge of the strike face and is at an angle of 60° relative to the imaginary horizontal ground plane;

a furthest rearwardly projecting point;

an overall length defined by the shortest horizontal distance between an imaginary front vertical plane, generally parallel to the top edge and passing through the center apex, and an imaginary rear vertical plane, parallel to the front vertical plane and passing through the furthest rearwardly projecting point of the club head;

an imaginary longitudinal vertical plane substantially perpendicular to the striking surface and passing through the face center;

an imaginary transverse vertical plane orthogonal to the imaginary longitudinal vertical plane and bisecting the club head at a point equidistant from the imaginary front vertical plane and the imaginary rear vertical plane, the imaginary transverse vertical plane intersecting the imaginary longitudinal vertical plane; and a linear stiffening element having a survey length denoting the maximum horizontal length of the stiffening element in a top plan view, the linear stiffening element being coupled to at least one of the crown portion and the sole portion, the linear stiffening element intersecting the imaginary longitudinal vertical plane and the imaginary transverse vertical plane and spaced from the intersection between the imaginary transverse vertical plane and the imaginary longitudinal vertical plane, the ratio of the overall width to the survey length being less than 0.97.

10. The golf club head of claim 9, wherein the ratio of the overall width to the survey length is less than 0.95.

11. The golf club head of claim 10, wherein the ratio of the overall width to the survey length is less than 0.90.

12. The golf club head of claim 9, wherein the ratio of the overall width to the survey length is between 0.85 and 0.97.

13. The golf club head of claim 9, wherein the overall width is greater than 100 mm.

14. The golf club head of claim 13, wherein the overall width is greater than 115 mm.

15. The golf club head of claim 9, wherein the first resonant frequency of vibration is between about 3000 Hz and about 5000 Hz.

16. A golf club head comprising:

a striking surface having a face center, a top edge, and a center apex;

a crown portion;

a sole portion;

a hosel having a hosel centerline, wherein the club head is oriented relative to an imaginary horizontal ground plane so that the hosel centerline is in an imaginary vertical hosel plane generally parallel to the top edge of the strike face and is at an angle of 60° relative to the imaginary horizontal ground plane;

a furthest laterally projecting toe point;

a furthest laterally projecting heel point, located at a vertical height of 0.75 in. relative to the ground plane;

an overall width defined by the shortest horizontal distance between an imaginary toe-side vertical plane, substantially perpendicular to the striking surface and passing through the furthest laterally projecting toe point, and an imaginary heel-side vertical plane, substantially perpendicular to the striking surface and passing through the furthest laterally projecting heel point;

a heel region comprising a width dimension Y, wherein the width dimension Y is less than about 20% of the overall width;

a toe region comprising a width dimension X, wherein the width dimension X is less than about 20% of the overall width;

a furthest rearwardly projecting point;

an overall length defined by the shortest horizontal distance between an imaginary front vertical plane, generally parallel to the top edge and passing through the center apex, and an imaginary rear vertical plane, parallel to the front vertical plane and passing through the furthest rearwardly projecting point of the club head;

an imaginary longitudinal vertical plane substantially perpendicular to the striking surface and passing through the face center;

an imaginary transverse vertical plane orthogonal to the imaginary longitudinal vertical plane and bisecting the club head at a point equidistant from the imaginary front vertical plane and the imaginary rear vertical plane, the imaginary transverse vertical plane intersecting the imaginary longitudinal vertical plane; and a linear stiffening element coupled to the sole portion and extending into the toe region, the linear stiffening element intersecting the imaginary longitudinal vertical plane and the imaginary transverse vertical plane and spaced from the intersection between the imaginary transverse vertical plane and the imaginary longitudinal vertical plane.

17. The golf club head of claim 16, wherein the linear stiffening element further comprises a thickness between about 0.5 mm and about 5 mm and a height between about 1 mm and about 25 mm.

18. The golf club head of claim 17, wherein stiffening element comprises a height between about 3 mm and about 20 mm.

19. The golf club head of claim 18, wherein the stiffening element comprises a height between about 5 mm and about 15 mm.

20. The golf club head of claim 19, wherein the stiffening element comprises a height between about 8 mm and about 12 mm.

* * * * *